US009366100B1

(12) United States Patent
Baudoin

(10) Patent No.: US 9,366,100 B1
(45) Date of Patent: Jun. 14, 2016

(54) HYDRAULIC PIPE STRING VIBRATOR

(71) Applicant: KLX ENERGY SERVICES LLC, Houston, TX (US)

(72) Inventor: Toby Scott Baudoin, Rayne, LA (US)

(73) Assignee: KLX Energy Services LLC, Houston, TX (US)

( * ) Notice: Subject to any disclaimer, the term of this patent is extended or adjusted under 35 U.S.C. 154(b) by 439 days.

(21) Appl. No.: 13/746,480

(22) Filed: Jan. 22, 2013

(51) Int. Cl.
*E21B 28/00* (2006.01)

(52) U.S. Cl.
CPC ..... *E21B 28/00* (2013.01)

(58) Field of Classification Search
USPC ..... 175/56, 55
See application file for complete search history.

(56) References Cited

U.S. PATENT DOCUMENTS 4,384,625 A 5/1983 Roper et al.
4,890,682 A 1/1990 Worrall et al.
6,152,222 A 11/2000 Kyllingstad
6,279,670 B1 * 8/2001 Eddison et al. ..... 175/107
6,439,318 B1 * 8/2002 Eddison et al. ..... 175/57
6,474,421 B1 11/2002 Stoesz
6,705,413 B1 * 3/2004 Tessari ..... 175/22
7,575,051 B2 8/2009 Stoesz et al.
8,162,078 B2 4/2012 Anderson
8,201,641 B2 6/2012 Allahar
2009/0223676 A1 * 9/2009 Eddison et al. ..... 166/381

* cited by examiner

*Primary Examiner* — Taras P Bemko
(74) *Attorney, Agent, or Firm* — Drinker Biddle & Reath LLP

(57) ABSTRACT

A vibrator apparatus to be positioned onto a pipe string is disclosed. The apparatus is comprised of a tubular housing, a tubular stator having a radial fluid opening, and a rotating rotor shaft with a longitudinally extending fluid bore and at least one radially extending fluid passage that intermittently aligns with the stator fluid opening. A rotation generator is provided to rotate the rotor shaft in response to fluid flow. Fluid flow through the fluid bore of the rotor shaft is discharged from the radially extending fluid passage of the rotor as it rotates in response to fluid flow and is intermittently interrupted by the stator as the rotor is rotated past the radial fluid opening in the stator thereby creating pulses in the fluid column and vibrating the pipe string.

21 Claims, 4 Drawing Sheets

HYDRAULIC PIPE STRING VIBRATOR

PRIORITY

This application claims priority to U.S. provisional application entitled "Hydraulic Pipe String Vibrator" bearing Ser. No. 61/591,068 filed Jan. 26, 2012, the entire content of which is hereby incorporated by reference.

FIELD OF THE INVENTION

This invention pertains to downhole equipment for oil and gas wells. More particularly, it pertains to a vibrator for use on a wellbore pipe string such as a drillstring or a coil tubing string and, more particularly, this invention relates to an apparatus for vibrating a pipe string and thereby reducing the coefficient of friction between the pipe string and the wellbore.

BACKGROUND OF THE INVENTION

During the advancement or manipulation of a pipe string in a wellbore such as a drillstring or a coil tubing string, it is often prudent to jar, vibrate, or oscillate the pipe string. This vibration aids in overcoming frictional forces between the pipe string and the interior surface of the wellbore.

Various types of vibrator devices have been employed with pipe strings in order to provide vibration. Some such vibrator devices typically employ reciprocating impact elements that move back and forth along the axis of the pipe string to induce vibration in the pipe string. Other such vibrator devices employ the use of eccentrically weighted rotating masses, eccentric shafts or rods, or rotatable impact elements that rotate about the longitudinal axis of the drill or pipe string to strike an impact anvil in order to apply a rotational or torsional vibration to the pipe string. Vibrator devices of these types typically generate vibration to a localized segment of the pipe string.

Still other types of vibrator devices utilize Moineau power sections that are generally used in downhole mud motors or pumps. Moineau power sections typically utilize rubber or rubber-like elastomers as seals which are negatively affected by elevated wellbore temperatures and pressures, certain drilling fluids and or chemicals, and contaminants or debris in the wellbore or drilling fluids.

Consequently, there is a need for a pipe string vibrator that will serve to induce vibration to a much larger percentage of the pipe string or the entire pipe string without being susceptible to the negative effects of temperature and pressure and other factors associated with a wellbore environment.

SUMMARY OF THE INVENTION

The present invention is a vibrator for a pipe string that satisfies the aforementioned needs. The vibrator is comprised of a tubular housing, a stator, a rotating shaft and a rotation generator section. The tubular housing is configured for attachment to a pipe string, coil tubing, or the like, that has a central bore through which fluid may be introduced. This fluid may be a liquid, gas, or a combination thereof. Positioned within the tubular housing is a sleeve known as a stator. The stator is configured to have one or more stator fluid ports. A rotating shaft known as a rotor is rotatably mounted within the stator. The rotor is rotated by means of a rotation generator section affixed to the rotor.

The rotor is comprised of a central shaft section having a longitudinal fluid bore. Positioned near the lower end of the longitudinal fluid bore of the rotor is a flow limiting device and outwardly extending fluid passages directed to the annulus created between the housing and the rotor. The rotor has one or more rotor fluid ports positioned toward the upper end that are also in communication with the annulus between the housing and the rotor. These fluid ports emanate from the radial surface of the rotor to allow fluid passage into the rotor from the housing-rotor annulus. The rotor is held in place within the housing by the stator and the upper and lower thrust bearings.

Fluid introduced in the central bore of the pipe string circulates through the rotation generator where the fluid then exits the rotation generator through a plurality of rotation generator fluid exit ports that are in communication with the central bore of the rotation generator. These rotation generator fluid exit ports are in a tangential orientation with respect to the outer surface of the rotation generator and are located at a desired distance from the central longitudinal axis of the vibrator apparatus. Fluid flow through the rotation generator fluid exit ports into the housing-rotor annulus serves to turn the rotor within the stator. The plurality of rotation generator fluid ports may be varied by number, size, shape, direction or orientation, and by any permutation thereof. Varying these features of the rotation generator fluid exit ports will allow the rotational speed of the rotor to be adjusted.

After the fluid from the rotation generator flows through the rotation generator fluid exit ports, the majority of that fluid will travel through one or more of the outwardly extending fluid passages in the rotor into the central longitudinal fluid bore of the rotor and a small percentage of that fluid will travel between the rotor and stator to act as a lubricant.

The flow of fluid in the central bore of the rotor will continue until the fluid flow is restricted at the lower end of the rotor by the fluid limiting device which is provided with a restrictive orifice. When the fluid limiting device is encountered, a predetermined portion of the fluid travels through the restrictive orifice of the flow limiting device. The remainder of the fluid in the central bore of the rotor will travel through the outwardly extending passages of the rotor which are located between the flow limiting device and the upper end of the rotor.

As the rotor rotates, the outwardly extending fluid passages of the rotor will intermittently become concentric to or aligned with the fluid ports in the stator. When this occurs, the fluid exiting the rotor is allowed to travel through the vibrator more freely due to the increased flow area provided by the alignment of a rotor fluid passage and the fluid ports in the stator. Similarly, as the rotor rotates, the outwardly extending fluid passages of the rotor will rotate past the fluid ports in the stator and be intermittently blocked by the stator thereby decreasing the fluid flow area through the vibrator. This process of increasing and decreasing the fluid flow areas as fluid flows through the vibrator creates pressure pulses in the column of fluid within the pipe string on which the vibrator is attached. These pressure pulses will cause the pipe string to oscillate or vibrate.

The process of increasing and decreasing the fluid flow areas within the vibrator is similar to placing a kink in a water hose then suddenly releasing the kink in a repeated fashion. Another example is the pulses created in a water pipe due to the opening and closing of a water faucet. If the faucet is suddenly closed, a pressure wave or surge in the fluid in the pipe will vibrate and rattle the pipe. This phenomenon is sometimes called the "fluid hammer effect". The vibrator disclosed does not completely close or shut off the fluid flow as in the examples above, but does restrict the flow enough to cause the same vibration effect.

In drilling or workover operations, the fluid flow through the vibrator must not be completely closed while pumping operations are ongoing as this can cause an unsafe pressure increase in the pipe string. In the vibrator presented herein, the fluid that travels through the stator to the housing-rotor annulus then travels to the lowermost outwardly extending port in the rotor then exits the vibrator. This lowermost outwardly extending port may not be necessary if the clearances between the lower end of the rotor and the lower thrust bearing are sufficient to allow adequate fluid flow.

In another embodiment of the vibrator, the rotation generator of the rotatably mounted rotor is comprised of a turbine having vanes of a desired geometry. Fluid diverted to the turbine from the housing-rotor annulus, through or across the turbine blades, serves to turn the rotor within the stator and thereby generates vibration along the length of the pipe string. The blades of the turbine can be varied by number, blade pitch, size and other attributes that may allow variation of rotational speed of the rotor.

In still another embodiment of the vibrator, the rotation generator of the rotatably mounted rotor is a vane motor which rotates in response to fluid flow through the motor. The geometry of the vane motor and stator can be varied to allow variation of rotational speed of the rotor.

DESCRIPTION OF THE EMBODIMENTS

Figure 1:
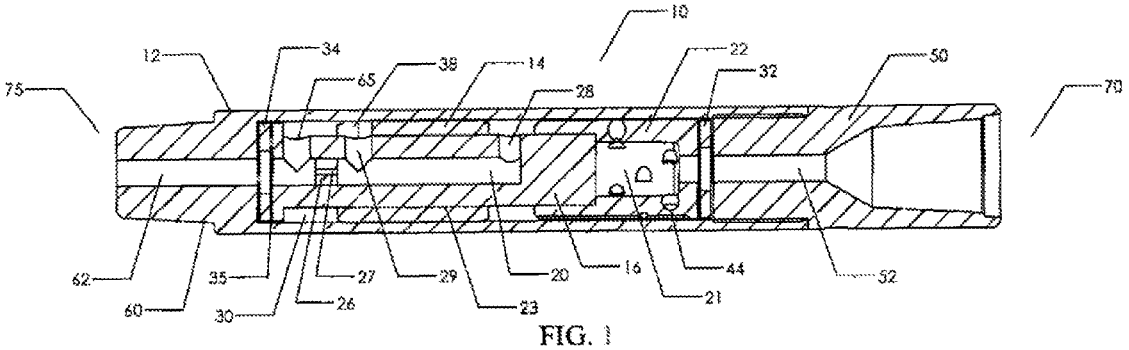
FIG. 1 is a longitudinal cross-section view of the vibrator apparatus.

FIG. 1 shows an embodiment of the vibrator apparatus (10) of the present invention. The vibrator apparatus (10) is configured for threadable attachment to a pipe string deployed in a wellbore, the pipe string having a central bore through which fluid may be introduced and circulated. The vibrator apparatus (10) is positioned on the pipe string so that the apparatus (10) extends longitudinally along the axis of the pipe string to which it is threadably attached.

In the configuration shown in FIG. 1, the vibrator apparatus (10) having an upper end (70) and a lower end (75) is comprised of a tubular housing (12) that is configured for threadable attachment to the pipe string by means of a top sub (50) and a lower threaded connection (60). The top sub (50) and the tubular housing (12) each having a central bore (52) and (62), respectively, for communication with the central bore of the pipe string. Housing (12) is illustrated as a single component but may consist of a plurality of individual parts threadably connected to one another.

Positioned within the housing (12) is a cylindrical stator (14). The stator (14) has at least one radial opening or stator fluid port (38) and is configured to receive a rotatably mounted rotor (16). The rotor (16) is comprised of a shaft section having a longitudinal fluid bore (20) in communication with at least one radially extending fluid passage port (28) at its upper end. Positioned in the fluid bore (20) near the lower end (35) of the rotor (16) is a flow limiting device (26) having a restricting orifice (27). The flow limiting device (26) is positioned between at least one intermediate radially outwardly extending fluid passage (29) of the rotor (16) positioned toward the lower end (35) and at least one lowermost radially outwardly extending fluid passage (65) of the rotor (16). Passages (29) and (65) extend from the fluid bore (20) of the rotor (16) into an annulus (30) created between the housing (12) and the rotor (16). Fluid passages (29) and (65) have a cross-sectional flow area substantially larger than the cross-sectional area of the restricting orifice (27).

Figure 2:
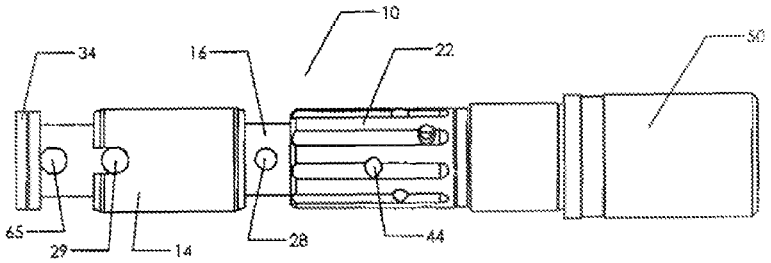
FIG. 2 is a top view of the vibrator apparatus as shown in FIG. 1 with the housing removed for clarity.

Affixed to the rotor (16) is a cylindrical rotation generator section (22). As shown in FIG. 2, a top view of the vibrator apparatus with the housing removed for clarity, a plurality of fluid exit ports (44) are cut as transverse chords through the cylindrical rotation generator section (22) of the rotor (16). These fluid exit ports (44) are positioned at a desired distance from the central axis of the rotor (16). The fluid exit ports (44) are also in communication with the annulus (30) between the housing (12) and the rotor (16) to allow fluid passage through the ports (44) to the housing-rotor annulus (30). The fluid exit ports (44) may be varied in number, size, shape, direction, spacing, or orientation, and by any permutation thereof, to allow the rotational speed of the rotor (16) to be adjusted as desired in response to fluid flow.

Referring again to FIG. 1, the stator (14) is held in place within the housing (12) between the rotation generator section (22) and the lower thrust bearing (34). The rotor (16) is positioned within the stator (14) so that the fluid passage (29) of the rotor (16) may be aligned with the stator fluid port (38) and is held in place within the housing (12) by lower thrust bearing (34) and upper thrust bearing (32). These thrust bearings (32) and (34) are illustrated as thrust washer type bearings but may consist of ball or roller bearings. The thrust bearings (32) and (34) may also be fitted with carbide, ceramic, PDC (polycrystalline diamond compact), or other hard materials as the bearing surface. The thrust bearings (32) and (34) may be of any material, size, number, type, or configuration. These thrust bearings (32) and (34) may also be tapered or otherwise configured to withstand both thrust and radial loads or forces.

Figure 7:
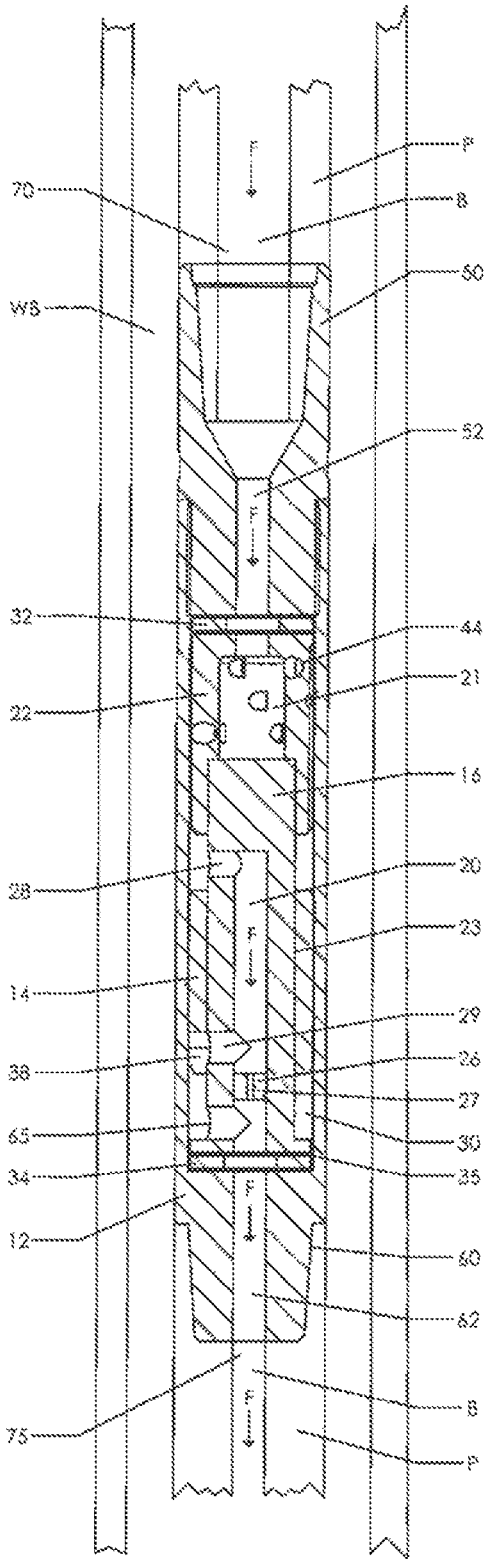
FIG. 7 is a longitudinal cross-section of a wellbore with the vibrator apparatus as shown in FIG. 1 attached to a pipe string.

FIG. 7 shows the vibrator apparatus (10) attached to a pipe string (P) having a central bore (B) in place in a wellbore (WB). In operation, as shown in FIG. 7, the upper end (70) of the vibrator apparatus (10) is threadably connected to the pipe string (P) by means of the top sub (50) and a lower threaded connection (60) so that the central bore (52) of the top sub (50) and the central bore (62) of connection (60) are in communication with the central bore (B) of pipe string (P). Fluid (F) introduced into the central bore (B) of pipe string (P) circulates through the central bore (52) of the top sub (50) and into bore (21) of the rotation generator section (22). There the flow of fluid (F) travels through fluid exit ports (44) into the housing-rotor annulus (30).

The flow of fluid (F) through fluid exit ports (44) serves to spin the affixed rotor (16) within the stator (14). The majority of the fluid (F) exiting fluid exit ports (44) into the housing rotor annulus (30) then flows through the upper radially outwardly extending passage port (28) into the central bore (20) of the rotor (16) with a small portion of the fluid (F) flowing into the annular space (23) between the stator (14) and rotor (16) to serve as a lubricant.

The portion of the fluid (F) flowing into the central bore (20) of the rotor (16) will encounter a fluid flow limiting device (26) having a restricting orifice (27) of a desired predetermined cross sectional area. The restricting orifice (27) will allow only a desired predetermined portion of the fluid (F) to pass through the orifice (27) from bore (20) and into the central bore (62) of connection (60). The remainder of the fluid (F) in the central bore (20) of the rotor (16) will be diverted by the fluid flow limiting device (26) into outwardly extending fluid passage (29). Fluid passage (29) is illustrated as a single passage but may comprise a plurality of passages, having similar or differing flow areas.

Fluid (F) diverted from central bore (20) of the rotor (16) through fluid passage (29) will encounter the stator (14). As the rotor (16) rotates within stator (14) the fluid passage (29) will be intermittently aligned and misaligned with the stator fluid port (38) of the stator (14). Consequently, there will be moments at which the fluid passage (29) is completely aligned, partially aligned, or not at all aligned with the stator fluid port (38). When passage (29) is completely aligned with the stator fluid port (38), the resistance to fluid flow (F) through the vibrator apparatus (10) is at its minimum and fluid (F) will travel through the vibrator apparatus (10) most freely at that moment. As the rotor (16) continues to rotate within stator (14), the fluid passage (29) eventually becomes substantially blocked by stator (14). At that moment, the resistance to the flow of fluid (F) through the vibrator apparatus (10) is at its greatest.

This cyclical process, where there is only intermittent alignment of passage (29) with the stator fluid port (38), provides a resulting increase and decrease of resistance to the flow of fluid (F) through the vibrator apparatus (10) creating pulses within the fluid column in the pipe string (P). This is sometimes called hydraulic shock. These pulses in the fluid column will cause the pipe string (P) to vibrate or oscillate. These vibrations can travel the full length of the pipe string (P).

Fluid flowing through the stator fluid port (38), then travels to bore (62) of the lower connection (60) either through fluid passage (65) of the rotor (16) or through clearances between the lower thrust bearing (34) and the lower end (35) of rotor (16) to exit the apparatus (10). If the clearances between the lower thrust bearing (34) and the lower end (35) of rotor (16) are adequate, fluid passage (65) may be eliminated.

Fluid passages (28), (29), and (65), as well as ports (38) and (44) can be varied by number, size, shape, direction or orientation, and by any permutation thereof to provide for adjustment of the rotational speed of the rotor (16). This adjustment can be used to vary the frequency of the fluid pluses in the column of fluid (F) in the central bore (B) of the pipe string (P) and the vibration of the pipe string (P).

Figure 3:
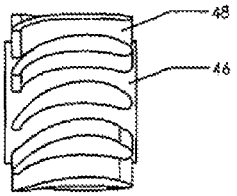
FIG. 3 is a side view of an alternate embodiment of the rotation generator of the vibrator apparatus showing the rotation generator as a turbine.

FIG. 3 shows an alternate embodiment of the rotation generator section (22) of the rotatably mounted rotor (16). In this embodiment the rotation generator section (22) is comprised of a turbine section (46) having radially extending blades (48) of a desired geometry. Fluid travels through bore (52) of the top sub (50) and into the housing-rotor annulus (30), then to the turbine blades (48). Fluid flowing across or through the turbine blades (48) serve to spin the rotor (16) within the stator (14), so that the passage (29) is completely aligned, partially aligned, or not at all aligned with opening or port (38) of stator (14), and thereby generating pulses in the fluid column pipe string (P) and vibration along the length of the pipe string (P). The blades (48) of the turbine section (46) of the rotation generator (22) can be varied by number, blade pitch, size and other attributes that may allow variation of rotational speed of the rotor.

Figure 4:
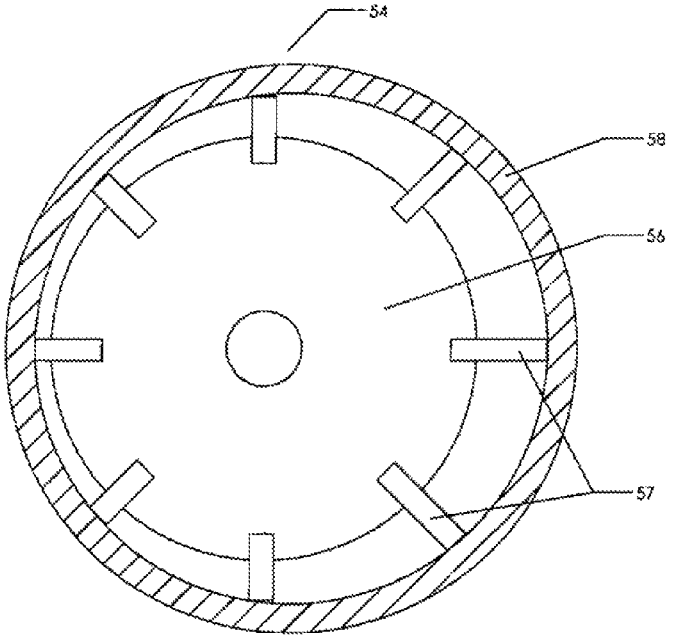
FIG. 4 is a side cross-sectional view of an alternate embodiment of the rotation generator of the vibrator apparatus showing the rotation generator as a vane motor.

FIG. 4 shows still another embodiment the rotation generator section (22) the vibrator apparatus (10). In this embodiment the rotation generator section (22) is a vane motor (54) of the type comprised of a vane motor rotor (56) with radially extending vanes (57) positioned within vane motor housing (58) having an eccentrically mounted vane motor rotor (56). The force differential created by the unbalanced force of the pressurized fluid on the vanes (57) of the vane motor (54) within the housing (58) will causes the vane motor rotor to spin in a desired direction.

The internal geometry of the vane motor housing (58) and vanes (57) of the vane motor (54) can be varied to allow variation of rotational speed of the vane motor rotor. The rotation of the rotor (56) of the vane motor (54) will provide corresponding rotation of the attached rotor (16) of the vibrator apparatus (10) so that the passage (29) of the rotor (16) is completely aligned, partially aligned, or not at all aligned with opening or port (38) of stator (14). This intermittent alignment and misalignment of the passage (29) and the port (38) of the stator (14) will result in generating pulses in the fluid column of the pipe string (P) and vibration along the length of the pipe string (P).

Figure 5:
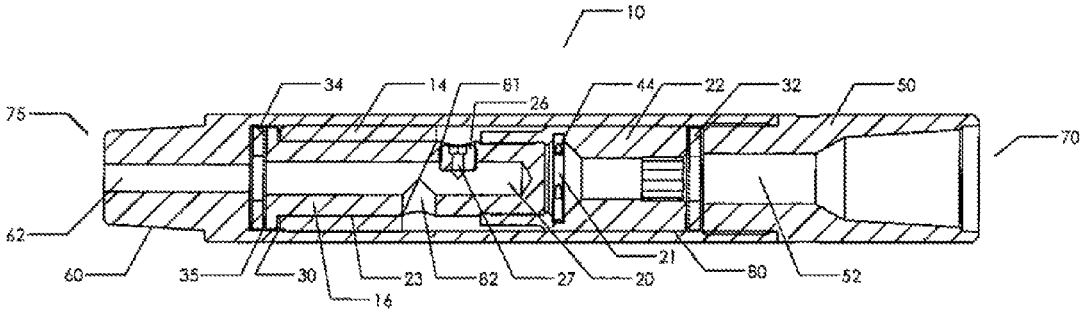
FIG. 5 is a longitudinal cross-section view of a second embodiment of the vibrator apparatus.
Figure 6:
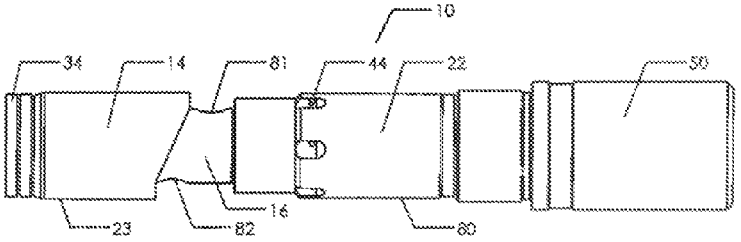
FIG. 6 is a front view of the second embodiment of the vibrator apparatus as shown in FIG. 5 with the housing removed for clarity.

A second embodiment of the vibrator apparatus (10) is shown in FIG. 5 and FIG. 6. In this second embodiment the rotor (16) is modified by omitting fluid passages (28), (29) and (65). The flow limiting device fluid (26) is also removed from the fluid bore (20) at the lower end (35) of the rotor (16) to allow the rotor bore (20) to be unrestricted.

The rotor (16) is then provided with a radially outward extending fluid passage (81) located at a position intermediate to the upper and lower ends of the rotor (16) that extends into the central bore (20) of the rotor (16). The flow limiting device (26) is relocated to this fluid passage (81). As in the embodiment of the apparatus (10) of FIG. 1, the flow limiting device (26) has the restricting orifice (27) of a predetermined cross sectional flow area to regulate the pressure drop across the restricting orifice (27) and the flow allowed through the vibrator apparatus (10).

The rotor (16) is also provided with a second radially outward extending fluid passage (82) that is also intermediate to the upper and lower ends of the rotor (16). This fluid passage (82) extends into the central bore (20) of the rotor (16) and serves as a fluid inlet into the rotor (16).

As shown in FIG. 6, the upper end of the stator (14) in the second embodiment is tapered or angled. This taper or angle provides the stator (14) with a radial sidewall of uneven length. When the rotor (16) is positioned within the stator (14) for rotation, the rotor (16) and the radial passage (82) rotates within the sidewall of the stator (14) in response to fluid flow. In doing, there is a point where the rotor (16) is positioned so that the passage port (82) is fully open with respect to the sidewall of the stator (14). As rotation of the rotor (16) continues, passage (82) is moved along the interior of the stator (14) where it becomes progressively partially blocked or restricted to fully blocked or restricted by the sidewall of the stator (14). In the configuration shown, the passage port (82) becomes fully blocked at a position 180 degrees from the fully open position. The passage port (82) will vary from being fully open with respect to the sidewall of the stator (14) to being fully closed with respect to the sidewall of the stator (14) depending on the position of the passage port (82) as the rotor (16) is rotated.

Figure 8:
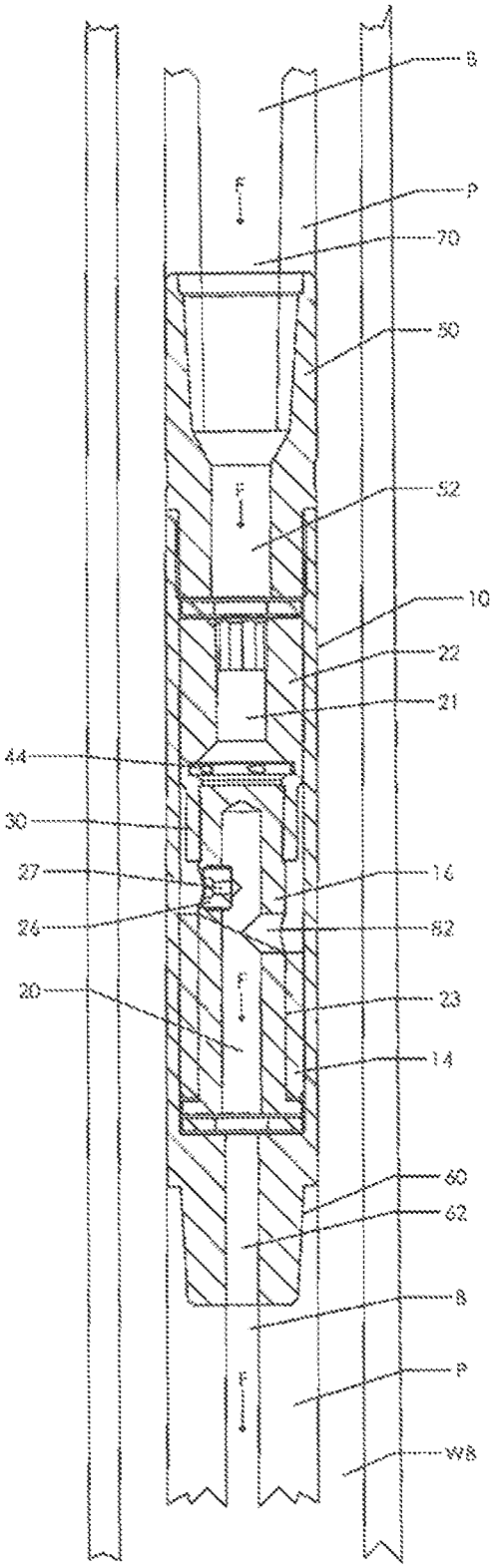
FIG. 8 is a longitudinal cross-section of a wellbore with the second embodiment of the vibrator apparatus as shown in FIG. 5 attached to a pipe string positioned in a wellbore.

FIG. 8 is a longitudinal cross-section of a wellbore with the second embodiment of the vibrator apparatus of FIG. 5 attached to a pipe string (P) having a central bore (B) positioned in a wellbore (WB). As shown in FIG. 8, the upper end (70) of the second embodiment of the vibrator apparatus (10) is threadably connected to the pipe string (P) by means of the top sub (50) and a lower threaded connection (60) so that the central bore (52) of the top sub (50) and the central bore (62) of connection (60) are in communication with the central bore (B) of pipe string (P).

In operation fluid (F) is introduced into the central bore (B) of pipe string (P) to circulate through the central bore (52) of the top sub (50) and into bore (21) of the rotation generator section (22). There the flow of fluid (F) travels through fluid exit ports (44) into the housing-rotor annulus (30). The flow of fluid (F) through fluid exit ports (44) of the rotation generator section (22) will spin the affixed rotor (16) within the stator (14).

As the fluid (F) exits fluid exit ports (44) into the housing-rotor annulus (30), a majority of that fluid then flows through the upper radially inwardly extending passage port (82) into the central bore (20) of the rotor (16). The remainder of the fluid (F) will flow into the annular space (23) between the stator (14) and rotor (16) to serve as a lubricant and then enter the rotor (16) through flow limiting device (26) positioned in passage (81).

As the rotor (16) is rotated within the stator (14) by the flow of fluid (F) passage port (82) is progressively fully covered and closed and fully uncovered and opened, and all variances in between, depending on the location of passage port (82) relative to angled sidewall of the stator (14). This opening and closing of passage port (82) causes cyclical pulses in the fluid (F) as the fluid (F) flows through passage port (82) into the central bore (20) of the rotor (16). This cyclical process provides a resulting increase and decrease of resistance to the flow of fluid (F) thereby creating pulses within the fluid column in the pipe string (P) as it flows through the vibrator apparatus (10) to exit into the central bore (62) of connection (60). These fluid pulses, sometimes called hydraulic shock, will cause the pipe string (P) to vibrate or oscillate. These vibrations can travel the full length of the pipe string (P).

In this second embodiment the flow of fluid (F) through of the vibrator apparatus (10) is interrupted during entry into the rotor (16) rather than upon exit and is thought to provide a more direct and less restrictive flow of fluid than that described in the first embodiment shown in FIGS. 1-4 and FIG. 7. The fluid passages (81) and (82), flow limiting device (26), and ports (44) of this second embodiment can be varied by number, size, shape, direction or orientation, and by any permutation thereof to provide for adjustment of the rotational speed of the rotor (16). The uneven sidewall of the stator (14) may be angled by means of a deep notch or multiple notches to increase the incidences of coverage of the passage (82) as the rotor (16) rotates within stator (14). The uneven sidewall may also be scalloped or curved in the fashion of a sine wave or otherwise configured in order to allow the passage port (82) to be blocked and unblocked by the stator (14) as the rotor (16) rotates. Such adjustments can vary the frequency of the fluid pluses in the column of fluid (F) in the central bore (B) of the pipe string (P) and the vibration of the pipe string (P).

The vibrator apparatus (10) described herein can be modified or adjusted prior to use to increase its effectiveness based on a predetermined fluid flow rate. Specifically, the frequency at which the vibrator apparatus (10) creates pulses in the column of drilling fluid can be set to achieve optimum results. The rotational speed of the rotor (16), i.e. (RPM), can be set based upon the configuration of the geometry of the rotation generator (22). If the rotation generator section (22) is a turbine, replacement turbines with different blade geometry can be utilized for varying the number of blades, blade pitch, and other attributes affecting the rotational speed of the rotor (16) and thereby affecting frequency of the generated fluid pulses.

It is thought that the vibrator apparatus (10) will be manufactured without the use of parts containing rubber or rubber substitutes or synthetics, such as those parts used with down hole mud motor power sections (often referred to as Moineau pumps). These power sections typically have a rubber lined stator to form a series of seals onto a rotor causing rotation when fluid is forced through the assembly. This rubber is negatively affected by elevated wellbore temperatures, many types of drilling fluids and chemicals, debris in drilling fluid, nitrogen and other additives to the wellbore. Such rubber often fails or disintegrates when a tool is downhole causing expensive and time consuming trips into or out of the wellbore.

It is also thought that the vibrator apparatus (10) will be short in length in comparison to vibrators that utilize mud motor power sections. Such reduction in length is especially important when the vibrator apparatus is utilized in coil tubing and or work over applications.

The vibrator (10) may also be used in conjunction with a shock sub or other devices utilized to increases the axial movement of a pipe string. Such devices are primarily used when running jointed pipe.

The vibrator described herein may be utilized in piping systems other than that of a wellbore or oilfield application. For example, the vibrator may be used in the cleaning of pipes in a pipeline or in piping systems such as those utilized in a refinery or chemical plant.

From the description set forth herein it can be seen that the vibrator apparatus (10) may utilized in any application where a fluid is being pumped through a conduit and where there is a need to reduce the friction between the conduit and the hole in which the conduit is travelling through.

Further, it is notable that the fluid from the pipe string that is introduced into the apparatus exits into and is maintained within the pipe string. If the apparatus (10) is utilized in a drilling application, all of the fluid will be maintained in the pipe string until it travels to the bit. This will allow for more effective cooling and cleaning.

It is thought that the vibration apparatus presented herein as well as its attendant advantages will be understood from the foregoing description and it will be apparent that various changes may be made in the form, construction and arrangement of the parts thereof without departing from the spirit and scope of the invention or sacrificing all of its material advantages, the form described herein being merely an example embodiment of the invention.

LISTING OF PARTS vibrator apparatus (10)
tubular housing (12)
stator (14)
rotor (16)
rotor longitudinal fluid bore (20)
rotation generator section bore (21)
rotation generator section (22)
rotor-stator annular space (23)
fluid flow limiting device (26)
fluid flow limiting device orifice (27)
upper rotor fluid passage (28)

intermediate rotor fluid passage of (29)
housing-rotor annulus (30)
upper thrust bearing (32)
lower thrust bearing (34)
rotor lower end (35)
stator fluid ports (38)
rotation generator section fluid ports (44)
turbine section (46)
turbine blades (48)
top sub (50)
top sub central bore (52)
vane motor (54)
vane motor rotor (56)
vane motor vanes (57)
vane motor housing (58)
tubular housing threaded connection (60)
tubular housing central bore (62)
lowermost rotor passage (65)
vibrator apparatus upper end (70)
vibrator apparatus lower end (75)
fluid passage (81)
fluid passage (82)

I claim:

1. A vibrator apparatus for generating pulses in a fluid column of a pipe string comprising:

(a) a tubular housing;

(b) a tubular stator positioned within said tubular housing, said stator having at least one radially extending fluid port in communication with said tubular housing;

(c) a longitudinally extending rotor rotatably mounted within said stator, said rotor having a central shaft, said central shaft having a longitudinal fluid bore with at least one radially extending rotor fluid passage; and (d) a rotation generator positioned on said rotor, said rotation generator section being configured to rotate said central shaft of said rotor in response to fluid flow through said central shaft whereby said rotor fluid passage intermittently aligns with said fluid port on said stator thereby intermittently interrupting said fluid flow through said central shaft, wherein said rotation generator is comprised of a cylindrical section attached to said central shaft of said rotor, said cylindrical section having a central bore and a plurality of tangentially extending fluid ports.

2. The apparatus as recited in claim 1 further comprising means for attaching said tubular housing to a pipe string.

3. The apparatus as recited in claim 1 wherein said rotation generator is a turbine.

4. The apparatus as recited in claim 1 wherein said rotation generator is a vane motor.

5. The apparatus as recited in claim 1 wherein said tangentially extending fluid ports are cut as transverse chords through said cylindrical section, wherein said ports are positioned at a desired distance from the central axis of said rotor.

6. A vibrator apparatus for generating pulses in a fluid column of a pipe string comprising:

(a) a tubular stator having at least one radially extending fluid port;

(b) a longitudinally extending rotor rotatably mounted within said stator, said rotor having a central longitudinally oriented fluid bore and at least one radially extending rotor fluid passage from said longitudinally oriented fluid bore; and (c) means for rotating said rotor in response to fluid flow through said longitudinally oriented fluid bore of said rotor whereby said radially extending rotor fluid passage only intermittently aligns with said radially extending fluid port on said stator and thereby intermittently interrupting said fluid flow from said fluid port of said stator, wherein said means for rotating said rotor is a rotation generator comprising:

(i) a cylindrical section attached to said rotor, said cylindrical section having a central bore in communication with said fluid bore of said rotor: and (ii) at least one tangentially extending fluid port through said cylindrical section.

7. The vibrator apparatus as recited in claim 6 further comprising means for attaching said tubular housing to a pipe string.

8. The vibrator apparatus as recited in claim 7 wherein said means for rotating said rotor is a turbine.

9. The vibrator apparatus as recited in claim 7 wherein said means for rotating said rotor is a vane motor.

10. The vibrator apparatus as recited in claim 7 wherein said tangentially extending fluid port is cut as a transverse chord through said cylindrical section, wherein said tangentially extending fluid port is positioned at a desired distance from the central axis of said rotor.

11. A vibrator apparatus for generating pulses in a fluid column of a pipe string comprising:

(a) a tubular housing;

(b) a tubular stator positioned within said tubular housing, said stator having at least one radially extending fluid port in communication with said tubular housing;

(c) a longitudinally extending rotor rotatably mounted within said stator, said rotor having a central shaft, said central shaft having a longitudinal fluid bore with at least one radially extending rotor fluid passage; and (d) a rotation generator positioned on said rotor, said rotation generator having a cylindrical section attached to said rotor, said cylindrical section having a central bore in communication with said longitudinal fluid bore of said central shaft of said rotor and a plurality of tangentially extending fluid ports cut as transverse chords through said cylindrical section whereby said central shaft of said rotor will rotate in response to fluid flow through said central shaft of said rotor and thereby intermittently aligning said rotor fluid passage with said fluid port on said stator so as to interrupt said fluid flow from said central shaft of said rotor.

12. The apparatus as recited in claim 11 wherein said tangentially extending fluid ports are positioned at a desired distance from the central axis of said rotor whereby the rotational speed of the rotor is varied thereby changing the vibration frequency.

13. The apparatus as recited in claim 12 further comprising means for attaching said tubular housing to a pipe string.

14. A vibrator apparatus as recited in claim 12 wherein said rotor is held in place within said housing by means of at least one thrust bearing.

15. In a pipe string having a central bore containing a fluid column, a method for vibrating said pipe string comprising the steps of:

(a) providing said pipe string having said central bore containing said fluid column;

(b) providing a tubular housing attached to said pipe string;

(c) providing a stator positioned within said tubular housing, said stator having at least one radially extending fluid port in communication with said tubular housing;

(d) providing a rotor shaft rotatably mounted within said stator, said rotor shaft having a longitudinally extending fluid bore and at least one radially extending fluid passage;

(e) providing a rotation generator attached to said rotor shaft whereby said rotor shaft may be rotated in response to fluid flow so as to intermittently align and misalign said radially extending fluid passage of said rotor with said radial fluid opening of said stator wherein said rotation generator is comprised of:

(i) a cylindrical section attached to said rotor shaft, said cylindrical section having a central bore in communication with said central bore of said pipe string, and (ii) at least one tangentially extending fluid port through said cylindrical section;

(f) providing a fluid flow from said fluid column in said pipe string thereby rotating said rotor shaft;

(g) directing said fluid flow through said pipe string into said longitudinally extending fluid bore of said rotating rotor; and (h) directing said fluid flow from said longitudinally extending fluid bore of said rotating rotor shaft as said radially extending fluid passage of said rotor shaft is intermittently aligned and misaligned with said radial fluid opening of said stator whereby fluid pluses in said fluid column of said pipe string are created and thereby vibrating said pipe string.

16. The method for vibrating a pipe string as recited in claim 15, wherein said rotation generator comprised of:

(a) a cylindrical section attached to said rotor shaft, said cylindrical section having a central bore in communication with said central bore of said pipe string; and (b) at least one tangentially extending fluid port through said cylindrical section.

17. The method as recited in claim 16 wherein said tangentially extending fluid port is positioned so as to vary the rotational speed of the rotor and thereby changing the frequency of said fluid pluses in said fluid column.

18. The method for vibrating a pipe string as recited in claim 15, wherein said rotation generator is a turbine.

19. The method for vibrating a pipe string as recited in claim 15, wherein said rotation generator is a vane motor.

20. A vibrator apparatus for generating pulses in a fluid column of a pipe string comprising:

(a) a tubular housing;

(b) a tubular stator positioned within said tubular housing, said stator having a tubular sidewall of uneven length;

(c) a longitudinally extending rotor rotatably mounted within said stator, said rotor having a central shaft, said central shaft having a longitudinal fluid bore with at least one radially extending rotor fluid passage; and (d) a rotation generator positioned on said rotor, said rotation generator section being configured to rotate said central shaft of said rotor in response to fluid flow through said central shaft whereby said rotor fluid passage is progressively interrupted by said stator sidewall thereby generating pluses in said fluid flow, wherein said rotation generator is comprised of:

(i) a cylindrical section attached to said rotor shaft, said cylindrical section having a central bore in communication with said pipe string; and (ii) at least one tangentially extending fluid port through said cylindrical section, wherein the central shaft of said rotor is rotated in response to fluid flow through the at least one tangentially extending fluid port.

21. In a pipe string having a central bore containing a fluid column, a method for vibrating said pipe string comprising the steps of:

(a) providing said pipe string having said central bore containing said fluid column;

(b) providing a tubular housing attached to said pipe string;

(c) providing a stator positioned within said tubular housing, said stator having a tubular sidewall of uneven length;

(d) providing a rotor shaft rotatably mounted within said stator, said rotor shaft having a longitudinally extending fluid bore and at least one radially extending fluid passage;

(e) providing a rotation generator attached to said rotor shaft whereby said rotor shaft may be rotated in response to fluid flow through at least one tangentially extending fluid port thereby progressively covering and uncovering said radially extending fluid passage of said rotor shaft with said stator sidewall;

(f) providing a fluid flow from said fluid column in said pipe string thereby rotating said rotor shaft;

(g) directing said fluid flow through said pipe string into said longitudinally extending fluid bore of said rotating rotor as said radially extending fluid passage of said rotor shaft is progressively covered and uncovered thereby creating fluid pulses in said fluid column of said pipe string and vibrating said pipe string.

* * * * *